US007446500B2

(12) United States Patent
Schulze et al.

(10) Patent No.: US 7,446,500 B2
(45) Date of Patent: Nov. 4, 2008

(54) METHOD FOR OPERATING A PROGRAMMABLE WASHING MACHINE

(75) Inventors: Ingo Schulze, Panketal (DE); Martina Wöbkemeier, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 334 days.

(21) Appl. No.: 10/527,254

(22) PCT Filed: Aug. 12, 2003

(86) PCT No.: PCT/EP03/08954

§ 371 (c)(1),
(2), (4) Date: Oct. 12, 2005

(87) PCT Pub. No.: WO2004/025012

PCT Pub. Date: Mar. 25, 2004

(65) Prior Publication Data

US 2006/0125428 A1 Jun. 15, 2006

(30) Foreign Application Priority Data

Sep. 9, 2002 (DE) ..... 102 41 682

(51) Int. Cl.
*H02P 1/26* (2006.01)

(52) U.S. Cl. ..... 318/772; 318/778; 318/268; 318/272

(58) Field of Classification Search ..... 318/772, 318/778, 268, 270, 271–276
See application file for complete search history.

(56) References Cited

U.S. PATENT DOCUMENTS 4,916,768 A * 4/1990 Broadbent ..... 8/159
4,977,394 A * 12/1990 Manson et al. ..... 340/679
5,832,553 A * 11/1998 Merloni ..... 8/159
6,158,072 A 12/2000 Baek et al.
6,381,789 B1 * 5/2002 Bernardino et al. ..... 8/158
6,777,894 B2 8/2004 Metz

FOREIGN PATENT DOCUMENTS

| | | |
|---|---|---|
| DE | 41 15 776 A1 | 11/1992 |
| DE | 199 08 363 A1 | 8/2000 |
| DE | 199 47 307 C1 | 11/2000 |
| DE | 101 32 199 C1 | 8/2002 |
| GB | 1 528 800 | 10/1978 |

* cited by examiner

*Primary Examiner*—Rina I Duda
(74) *Attorney, Agent, or Firm*—Russell W. Warnock; James E. Howard

(57) ABSTRACT

In an anti-crease operation incorporated after the program sections wash and spin to loosen laundry in the drum, the user should be offered the possibility of being able to actively influence this operation. For selecting the adjustable parameters for the duration and sequence of the anti-crease program the user is supported by a display and can depart upward or downward from predetermined values dependent on type or textile and loading after checking for compatibility. The detachment of the laundry ring at the inner wall of the drum can be monitored by measuring valid variables of state as a criterion for loosened and disentangled laundry at the beginning of the anti-crease operation in the reversing phases and comparing these with desired data which were determined in a short analysis section installed before the beginning of the actual wash program. As a result, errors in identifying a laundry ring can be largely avoided.

23 Claims, 3 Drawing Sheets

METHOD FOR OPERATING A PROGRAMMABLE WASHING MACHINE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to a method for operating a programmable washing machine comprising a laundry drum arranged rotatably inside a soap-solution container, which can be moved program-dependently with different speed profiles in both directions of rotation and comprising a real-time clock by means of which the user himself can determine the beginning or end of the washing process.

Appliances are supplied by a number of washing manufacturers in which an anti-crease function is fixedly installed as a section incorporated after the final spin. In these known appliances the anti-crease program section or the duration and sequence is the same and fixedly predetermined for all types of laundry and all loads. The user of the washing machine merely has the possibility for switching off the anti-crease system. Further interventions are not provided.

In washing machines during spinning at the high speeds normal today, it regularly occurs that a ring of laundry forms on the inner wall of the drum which frequently does not become detached even after the drum has stopped. This results in increased creasing and makes it difficult to unload the drum. The laundry ring has a very disadvantageous effect when a drier is integrated in the automatic washing machine. An non-detached laundry ring hinders uniform and rapid drying of the washing. In order to counteract this, an anti-crease operation is incorporated after the spinning in many washing machines. In this case, the drum is moved for a short time at a speed below the feed speed in several intervals in the direction opposite to the direction of rotation during spinning. In many cases, this is sufficient to detach the laundry from the drum and disentangle it.

2. Description of Related Art

Such a reversal of the direction of rotation to disentangle the washing in the drum is known from DE 41 15 776 A1 as an intermediate step during rinsing and spinning wherein here the emphasis is not on the anti-crease system but the redistribution of the washing in the drum for better rinsing and final rinsing of the individual items of laundry. DE 198 31 617 A1 describes a method for determining the quantity of washing in a drum in which a plurality of laundry disentanglement steps are provided for error correction.

The methods described with the fixedly predetermined parameters for speed, acceleration and braking speed are not optimal with reference to effective anti-crease system. With the known methods or process steps the anti-crease function cannot be adapted to the different conditions such as load and textile properties of the washing. The methods provide no satisfactory certainty that the laundry ring is actually detached. This is especially problematical at speeds above 1400 $min^{-1}$ at which the laundry ring adheres tightly to the inner wall of the drum and is inherently relatively stable.

DE 199 47 307 C1 describes a method in which the final spin is followed by a program section in which the detachment of the laundry ring from the inner wall of the drum is monitored by measurement technology. For this purpose the mechanical vibrations of the soap-solution container as a result of falling washing are recorded. This is accomplished by evaluating the dynamic signal fraction of a position or force sensor or by evaluating the signals of an acceleration sensor. In order to avoid misinterpretations of the measurement data for very small quantities of laundry, the weighting value which was determined during the washing process or input by the user, is incorporated during the internal evaluation by the microprocessor control system. After identifying a laundry ring, an attempt is made to detach the laundry ring by controlling the drum drive with short and strong accelerating or braking pulses. The success of this measure is then checked by re-evaluation of the sensor signal.

The method described also provides no possibility for intervening in the automatically running program and individually manipulating according to the wishes and experience of the user. The success of the method described in relation to the detachment of a laundry ring adhering to the inner wall of the drum depends only on the sensitivity and accuracy of the sensors, which is problematical with very small amounts of laundry or very light laundry.

BRIEF SUMMARY OF THE INVENTION

It is the object of the invention to provide an improved method for loosening the washing after the final spin in which the user can himself determine the anti-crease program within broad limits according to his wishes and experience. It is further the object of the invention to support the user as far as possible in selecting the parameters which can be adjusted and selected by him for the sequence of the anti-crease program and to improve the detection of a laundry ring.

The object is solved according to the invention by the features specified in the principal claim. Additional advantageous embodiments of the inventive method are specified in the dependent claims.

The invention represents an extension and further improvement of known washing methods in respect to careful treatment of the laundry, especially with regard to an optimal loosening of the textiles after the spinning. In this case, the user is given the possibility of actively influencing the program. It is important to the invention that the anti-crease program as defined by the invention can be freely programmed with reference to its start and end time, the running time and the sequence. The user can independently configure the anti-crease system according to the given individual conditions and according to his personal wishes and experiences. In this case, in the embodiment of the invention the user is supported by the program by the internal determination of default values for the parameters which can be manipulated by monitoring the detachment of laundry rings which form on the inner wall of the drum during the spinning.

The invention is explained subsequently in detail with reference to a program example shown in the drawings.

BRIEF DESCRIPTION OF THE SEVERAL VIEWS OF THE DRAWING(S)

DETAILED DESCRIPTION OF THE INVENTION

Figure 1:
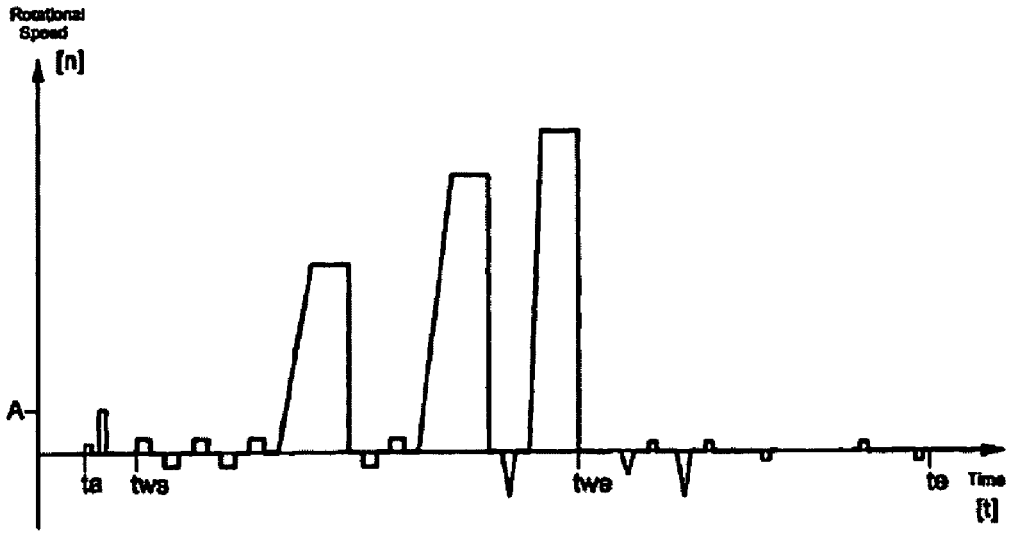
FIG. 1 is a graph of drum rotational speed v. time according to one preferred embodiment of the present invention.
Figure 2:
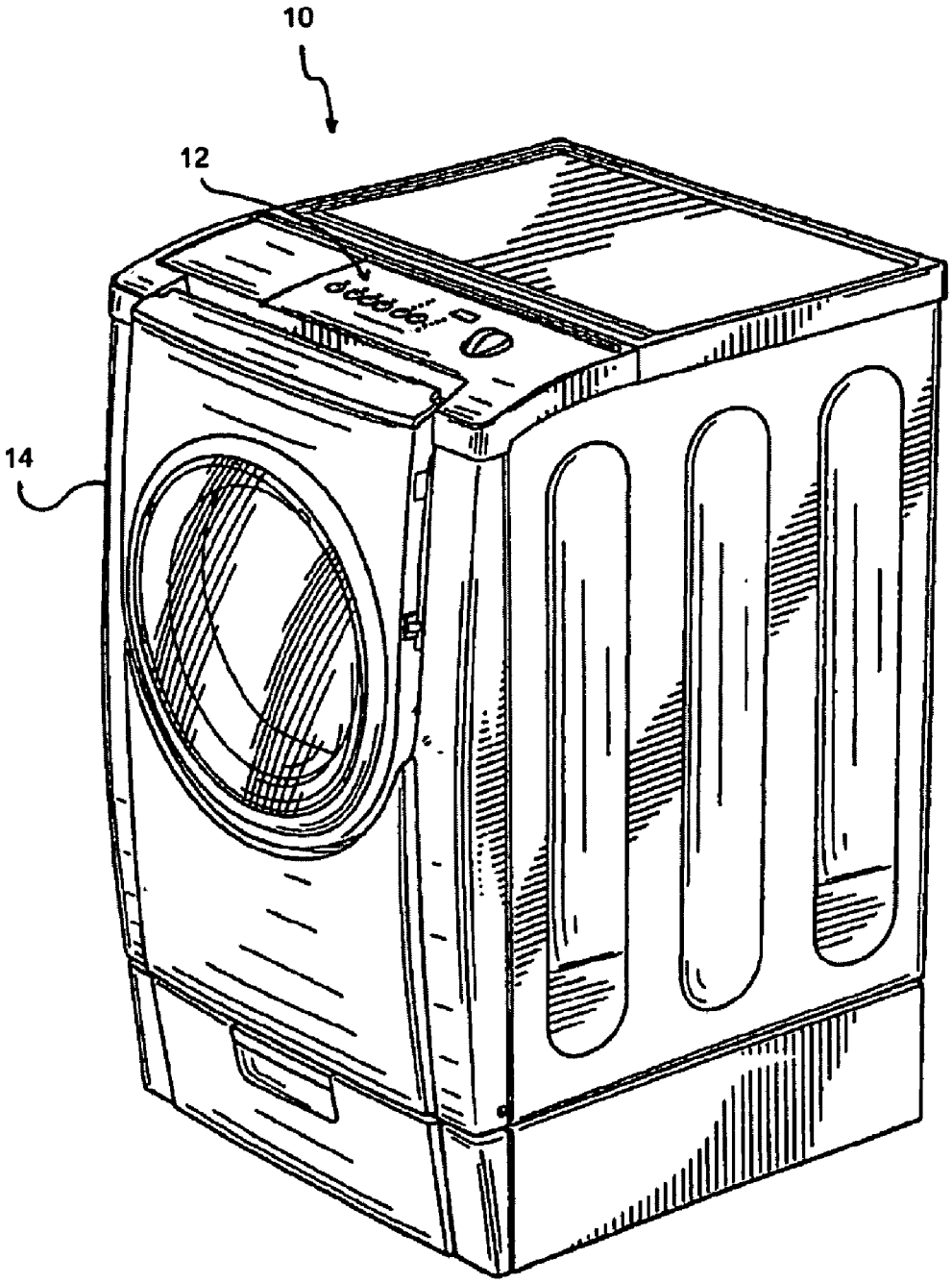
FIG. 2 is a perspective view of a washing machine according to a preferred embodiment of the present invention.
Figure 3:
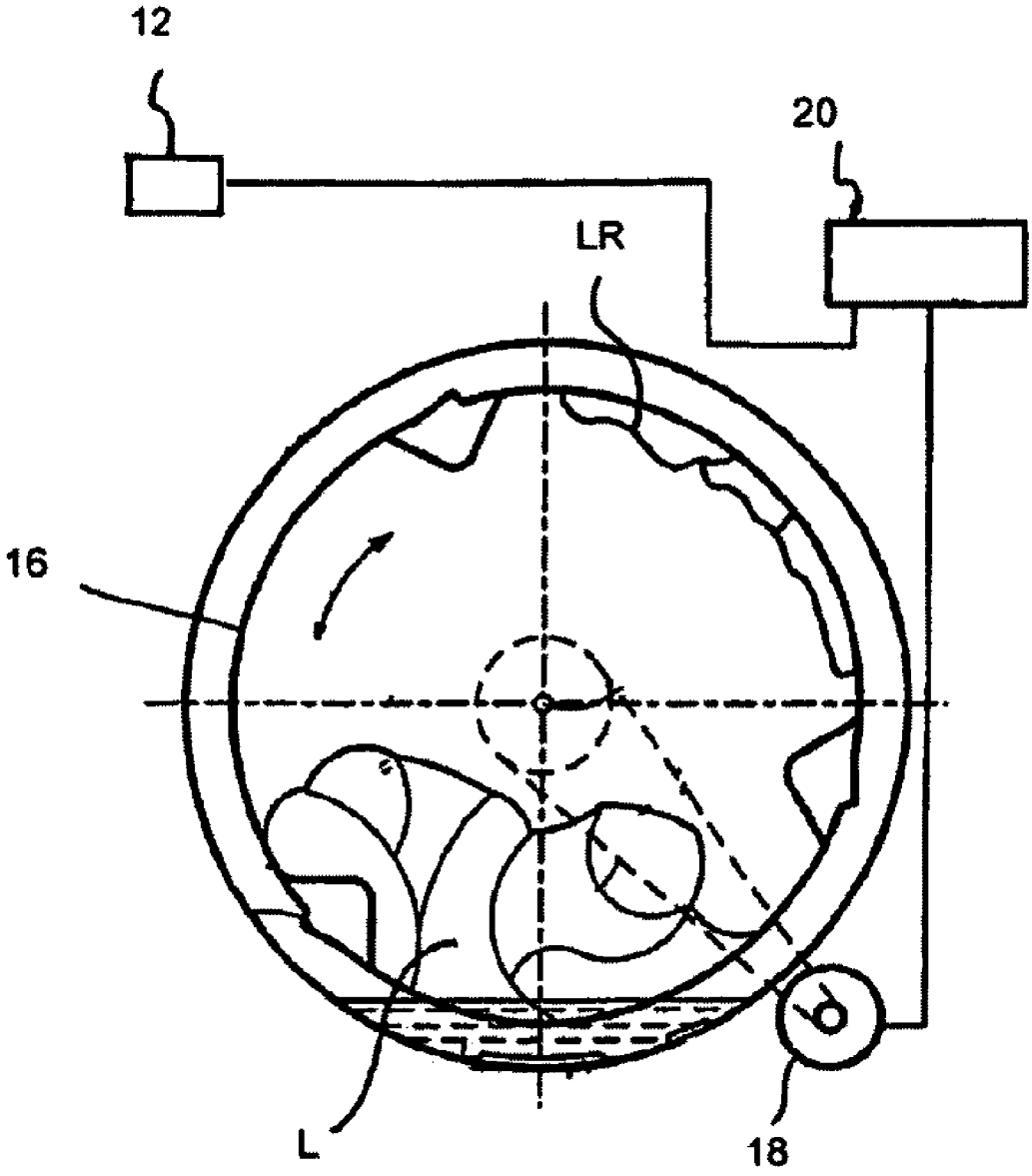
FIG. 3 is a diagrammatic front view of a washer drum according to the preferred embodiment of the present invention.

In this example, and with reference to FIG. 2, a washing machine 10 with an intelligent expert system and a display indicator 12 on which important information is made visible to the user and with which a dialogue operation with the user is possible is taken as the starting point. The washer includes a drum 14 as seen in FIG. 3 that is driven into rotation by a motor 18 controlled by a control system 20 in communication with the user input and display 12. The drum 14 is contained within a soap-solution container or housing 22. As seen in FIG. 1, the program sequence is shown schematically by a speed-time diagram where specific details have been eliminated since these are not important for the understanding of the invention. The washing machine is operated during the operations "wash" and "rinse" beginning at time $t_{ws}$ at low speeds in reversing mode, i.e. with alternating direction of rotation. For reasons of simplification in the diagram the edges of the reversing cycles are shown as verticals whereas in reality the drum is accelerated slowly, i.e., in an energy-saving fashion, to the desired speed. The same applies to the reversing cycles of the anti-crease operation.

With reference to FIG. 3, shown following the washing phase, identifiable from the high speeds, are a rinsing section and two spinning operations with an interposed loosening operation in which the laundry drum 16 is moved at reduced speed compared with the spinning but with an opposite direction of rotation. After the final spinning which is executed at the maximum speed, the actual washing program is ended at time $t_{we}$.

The following anti-crease operation is designed to loosen the laundry L in the drum and maintain this state over the time to prevent the laundry L already loosened in the drum from being pressed together again in an undesirable fashion by lying too long, creases from forming and making it difficult to remove the individual items of laundry. Apart from a short section at the beginning of the anti-crease operation, this program section following the spinning is determined by a reversal of the drum 16 at constant speed and the same duration of rotation and rest phases until a predetermined end $t_e$. The parameters for this section can be selected freely in which case the user is supported by the system of the washing machine in the fashion that the user is guided via the display 12. The programming of the anti-crease operation is described subsequently.

After the usual program selection for the washing process and the entry of additional parameters for manipulating the washing program, the system enquires via the display whether the anti-crease system is required. After confirmation by the user, a duration is indicated on the display which is determined by the intelligent evaluation system depending on the type of textile from a supply of default values fixedly stored in the memory and which determines how long the anti-crease operation should last after the final spin. The user can shorten or lengthen this pre-determined time by suitable entries. Alternatively to the running time of the anti-crease system the user can select the function "program end time" and determine via this the time at which the program switches off. The duration of the anti-crease operation is then obtained automatically from the time difference between the time of the final spin $t_{we}$ and the selected end time $t_e$. An incorrect entry of the end time by the user, possibly such that the selected end time lies before the end of the final spin does not result in interruption of the program but merely has the result that the parameter "program duration" is allocated the value "zero", and thus the anti-crease system is not activated at all. Subsequently values for the parameter "speed", "duration of rotation" and "time interval" are indicated to the user in the display which the user can either confirm or correct upwards or downwards.

The values set by the user for the anti-crease operation are checked internally in the control system 20 for compatibility with the selected laundry care program, including the additional parameters. For example, if the user selects a too-high speed for delicate textiles, this is indicated in the display 12, for example by repeated flashing of the numerical value.

All default values indicated automatically by the system are derived from measurement data stored in the memory which has been obtained from a plurality of comparative tests, from the wash program selected by the user including the additionally entered parameters and the loading of the drum detected by a suitable sensor system. The values determined by the internal evaluation system and indicated on a display are determined under the premise of ensuring an effective anti-crease system which however is as energy-saving as possible. If the anti-crease system is required by the user but is not specified by any entries, the program runs as specified by the default values.

The first section after the spinning, beginning from the time $t_{we}$ is controlled by the intelligent expert system and runs automatically. The duration of this first section depends on reaching of a target function, i.e., reaching predetermined variables of state which can be valid as the criterion for detachment of the laundry ring LR (See FIG. 3) adhering to the inner wall of the drum 14 after the final spinning and for a looser disentangled washing. Suitable for this are mechanical, acoustic and optical quantities such as, for example, the speed profile, torque, imbalance, impact noises, reflection and scattered light. The detachment of the laundry ring LR is monitored by measuring one or a plurality of variables of state at the beginning of the anti-crease operation in the reversing phases and comparing these with desired data which have been determined as the criterion for loosened and disentangled laundry. With reference to FIG. 1, the desired measured values are determined in a short analysis section ($t_a$) incorporated before the actual beginning of the wash program (time $t_{ws}$) in which the drum is moved in two short sections at various speeds. The speed of the first phase is equal to the speed selected for the anti- crease system and in the second phase the drum 14 is moved at the feed speed A. The measured values from the first section correspond to the desired state of a loosened disentangled quantity of laundry items strived for by the anti-crease system. During rotation of the drum 14 at the feed speed the state which is absolutely to be avoided as the final state is measured. Extreme deviations caused by loading the drum with wet laundry are corrected inside the control system. By means of this procedure the monitoring measuring device is re-calibrated for each wash run. Especially as a result of the relationship between two measured values comparative values are determined with which errors during identification of a laundry ring LR, caused by various properties, especially very small loads or weight, caused by textile-specific properties or other rather random features of the washing, can be largely avoided.

The invention claimed is:

1. A method for operating a programmable washing machine comprising a laundry drum arranged rotatably inside a soap-solution container, which can be moved program-dependently with different speed profiles in both directions of rotation and comprising a real-time clock by means of which the user himself can determine the beginning or end of the washing process, and comprising an anti-crease operation incorporated after the wash and spin program sections for loosening the laundry in the drum, associated with an intermediate step in which the drum drive is driven with short and strong accelerating or braking pulses to bring about the detachment of a ring of laundry lying against the inner wall of the drum, formed during the spinning and in which the successful detachment of the laundry ring is monitored by means of comparative measurement data which are automatically determined by the program control system, wherein the subsequent anti-crease operation can be manipulated by the user.

2. The method according to claim 1, wherein the start and end time of the entire wash program including at least one of the anti-crease operation and the duration of the subsequent anti-crease operation can be freely selected by the user as well as the speed, duration of rotation and the time intervals between the rotation phases.

3. The method according to claim 1, wherein when programming the anti-crease program section the user is guided and supported by means of a display in the manner that the program specifies to the user via the display values for the parameters speed, duration of rotation, duration of rest phases and total duration which are derived internally in the control system as a favorable average from a plurality of measurement data determined in comparative tests and stored in the memory, from the wash program selected by the user including the additionally input parameters and from the loading of the drum determined by the sensors, and that these default values can be changed at least one of upwardly and downwardly by the user.

4. The method according to claim 1, wherein the values set by the user for the anti-crease operation are compared internally in the control system with the selected laundry care program including the additional parameters and are checked for compatibility, and that an incompatible value is indicated in the display.

5. The method according to claim 4, wherein an incompatible value is indicated by repeated flashing of the display indicator.

6. The method according to claim 1, wherein for monitoring the detachment of the laundry ring from the inner wall of the drum at the beginning of the anti-crease operation in the reversing phases, at least one of mechanical, acoustic and optical measurement data are recorded and these are compared with the corresponding measurement data which are obtained from the short analysis section incorporated before the wash program.

7. The method according to claim 6, wherein the comparative data are recorded during rotation of the laundry drum at feed speed and at a speed which was specified by the user for the anti-crease system.

8. The method according to claim 1, wherein when a laundry ring is identified, the laundry drum is briefly moved with high acceleration and braking pulses and that when a laundry ring is repeatedly registered, the laundry drum is moved with gradually increased accelerating and braking pulses to detach the laundry ring.

9. A method for operating a programmable washing machine having a program control system with a memory for controlling operation of the washing machine, a laundry drum arranged rotatably inside a soap-solution container, with the drum being movable at different speeds in both directions of rotation and being controllable by programs from the program control system, a display device, and a timing device by means of which the user himself can determine the beginning or end of the washing process, the method comprising the steps of:

receiving input data from the user;

performing a washing program wherein the drum and laundry are rotated in a soap solution to wash the laundry;

performing a spinning program in which the drum is rotated at a relatively high speed to remove water from the laundry, wherein a laundry ring may be formed lying against the inner wall of the drum during the spinning program;

performing an anti-crease operation incorporated after the wash and spin program sections for loosening the laundry in the drum, the anti-crease operation comprising:

driving the drum with short and strong accelerating and braking pulses to detach the laundry ring lying from the inner wall of the drum; if a laundry rings has formed, monitoring detachment of the laundry ring with a sensor sensing measurement data of the laundry ring and the program control system comparing the measurement data to initial measurement data; and adjusting the anti-crease operation with the program control system in response to the input data from the user.

10. The method according to claim 9, wherein the anti-crease operation includes multiple rotation phases and the input data from the user includes desired operating parameters for the anti-crease operation including the duration of the anti-crease operation, the speed and duration of drum rotation during the rotation phases, and the time intervals between the rotation phases.

11. The method according to claim 9, further comprising the following acts:

determining operating parameters for the anti-crease operation including speed, duration of rotation, duration of rest phases, and total duration with the program control system from a plurality of measurement data determined in comparative tests and stored in the memory;

displaying the operating parameters for the user on the display device; and receiving adjusted values of the operating parameters from the user.

12. The method according to claim 11, further comprising the following acts:

comparing the adjusted values set by the user with pre-determined operating parameters in the program control system, and determining if the adjusted values are compatible with the pre-determined operating parameters; and providing a signal on the display device if the adjusted values are incompatible with the pre-determined operating parameters.

13. The method according to claim 12, wherein the signal includes a repeated flashing on the display device.

14. The method according to claim 9, further comprising the act of measuring the initial measurement data with the sensor before the act of performing the washing program, the initial measurement data representing a start condition and the measurement data during the anti-crease operation being compared to the initial data from before the washing program to determine if the laundry ring has detached and returned to the start condition, wherein the measurement data sensed by the sensor includes at least one of mechanical, acoustic and optical measurement data.

15. The method according to claim 14, further comprising the act of recording the measurement data during rotation of the laundry drum at feed speed and at a speed which was specified by the user for the anti-crease operation.

16. The method according to claim 9, further comprising the act of moving the laundry drum with relatively high acceleration and braking pulses when a laundry ring is identified, and gradually increasing the accelerating and braking pulses to detach the laundry ring when the laundry ring is repeatedly registered.

17. A programmable washing machine comprising:

a program control system with a memory and controlling operation of the washing machine;

a soap-solution container for retaining liquids;

a laundry drum for receiving laundry and being arranged rotatably inside a soap-solution container, the drum being movable with different speed profiles in both directions of rotation and being controllable by washing programs, spinning programs, and anti-crease operations from the program control system;

a display device displaying operational data of the washing machine for a user;

an input device for receiving input data from the user, the input data being transferred to the program control system;

a timing device for use by a user to set at least one of the beginning and end of the washing process;

a sensor sensing measurement data to detect the presence of a laundry ring formed against an inner wall of the drum, the sensor sensing initial measurement data before the running of the washing program and sensing current measurement data during the running of the anti-crease operation, the program control system comparing the current measurement data and the initial measurement data to determine the presence of the laundry ring;

means for adjusting the operating parameters of the anti-crease operation in response to the input data from the user, the anti-crease operation including driving the drum with short and strong accelerating and braking pulses to detach the laundry ring lying from the inner wall of the drum; and means for adjusting the operating parameters of the anti-crease operation in response to the program control system determining the presence of the laundry ring.

18. The washing machine according to claim 17, wherein the operating parameters include the duration of the anti-crease operation, the speed and duration of drum rotation, and the time intervals of rest phases between drum rotation.

19. The washing machine according to claim 17, wherein the measurement data sensed by the sensor includes at least one of mechanical, acoustic and optical measurement data.

20. The washing machine according to claim 17, wherein the program control system includes a memory and the measurement data sensed by the sensor is recorded in the memory of the program control system.

21. A method for operating a programmable washing machine having a laundry drum rotatably disposed inside a soap-solution container, said drum being configured for controlled movement at different speeds in both directions of rotation and including a real-time clock by means for determining the duration of the washing process, and a user interface for displaying information for a user and for receiving user input, wherein the washing machine is programmed to perform said method comprising the steps of:

executing a washing program wherein said drum is rotated relatively slowly in alternating directions to immerse clothes being washed in a soap-solution;

monitoring predetermined operational parameters to determine whether a laundry ring has formed against the drum, and, upon sensing a laundry ring, rotating the drum with relatively short strong pulses to dislodge the laundry ring;

executing a rinsing program wherein said drum is rotated at a relatively moderate speed in a single direction to rinse soap from clothes being washed;

executing a spin program wherein said drum is rotated at a relatively high speed to extract water from clothes being washed;

executing an anti-crease program wherein said drum is rotated in alternating directions for loosening the laundry in the drum.

22. The method for operating a programmable washing machine according to claim 21 said anti-crease operation can be manipulated by the user and said method further includes the steps of presenting options for adjusting predetermined program parameters by a user using said user interface to input adjustments.

23. The method for operating a programmable washing machine according to claim 21 and further comprising the steps of adjusting at least one of the anti-crease operational program duration, rotational speed and duration of rotation.

* * * * *